United States Patent [19]

Williams

[11] 4,380,230

[45] Apr. 19, 1983

[54] SCALP MASSAGING APPARATUS

[76] Inventor: Arden Williams, 3993 Plumcrest Cir., Smyrna, Ga. 30080

[21] Appl. No.: 283,090

[22] Filed: Jul. 13, 1981

[51] Int. Cl.[3] ..... A61H 7/00

[52] U.S. Cl. ..... 128/49; 128/62 R

[58] Field of Search ..... 128/24 R, 25 R, 51, 128/52, 53, 65, 66, 62 R, 33, 49

[56] References Cited

U.S. PATENT DOCUMENTS

| | | | |
|---|---|---|---|
| 117,580 | 8/1871 | Wark | 128/62 R |
| 1,384,072 | 7/1921 | Kercher | 128/62 R |
| 1,523,979 | 1/1925 | Ryan | 128/62 R |
| 1,712,764 | 5/1929 | Hassler | 128/62 R |
| 2,467,007 | 4/1949 | Boyd | 128/52 |
| 2,475,289 | 7/1949 | MacGregor | 128/33 |
| 2,566,600 | 9/1951 | Colon | 128/65 |
| 3,044,473 | 7/1962 | Cover | 128/64 |
| 3,630,569 | 12/1971 | Lory | 297/361 |

*Primary Examiner*—Richard J. Apley
*Assistant Examiner*—David J. Brown
*Attorney, Agent, or Firm*—Rodgers & Rodgers

[57] ABSTRACT

A scalp massing apparatus is mounted on a couch-like structure adapted for supporting the body of a user in an inclined position and comprises a pair of helmet sections having sponge-like inner surfaces and arranged to receive the head of a user together with yieldable biasing means arranged to bias the helmet sections toward each other and toward the head of the user and vibratory driving means interconnected with said helmet sections and supported by a part of the couch-like structure for imparting reciprocatory movement to the helmet sections thereby to massage the scalp of the user, the helmet sections being laterally adjustable to accommodate different head sizes and the helmet sections together with the associated reciprocatory driving means being adjustable relative to the shoulders and head of the user so as to accommodate persons of different stature and shoulder engaging means being adjustable relative to the couch-like structure so as properly to position the head of the user relative to the helmet sections.

5 Claims, 6 Drawing Figures

SCALP MASSAGING APPARATUS

TECHNICAL FIELD

The invention relates to a power driven apparatus mounted on counch-like support structure and positioned with respect thereto so as to engage and massage the scalp of a user.

BACKGROUND ART

U.S. Pat. No. 2,467,007 issued Apr. 12, 1949 discloses a vibrating and massaging apparatus in which a rigid hood surrounds and supports a pair of massaging elements together with a driving mechanism disposed within the rigid hood for imparting forward and backward movement to each of the massaging elements. The arrangement of U.S. Pat. No. 2,467,007 does not provide means for positioning the body and head of the user relative to the vibrating and massaging apparatus and also does not provide for yieldably mounting the massaging elements so as to accommodate floating movement thereof, the massaging sections being mechanically coupled to their associated driving means so that no provision in this structure is made for yieldable movement of the massaging elements relative to each other. This arrangement thus is rigid in its structure and function and conceivably could cause discomfort and possible injury to the head and scalp of the user.

U.S. Pat. No. 2,566,600 issued Sept. 4, 1951 discloses a rigid hood for receiving the head of a user. Inside of the hood a rigid lining 6 is disposed and spaced from the outer rigid hood and to the inner surface of which a plurality of massaging fingers are mounted. Reciprocatory means is connected to the outer rigid hood and imparts vibratory motion to the entire hood as well as to the inner rigid liner and the sponge like fingers disposed about the inner surface of the liner. There is no provision in U.S. Pat. No. 2,566,600 for positioning the body and head of the user relative to the vibratory mechanism and there is no provision in this structure for yieldable movement of the rigid hood relative to the head of the user.

DISCLOSURE OF THE INVENTION

According to this invention in one form, a pair of complementary relatively movable helmet sections having sponge like inner surfaces are arranged to receive the head of a user and yieldable biasing means arranged to bias the helmet sections toward each other and toward the head of the user is provided as well as vibratory driving means interconnected with the helmet sections and effective to impart reciprocatory movement thereto thereby to massage the scalp of the user. According to one facet of the invention, the user's body is supported and adjustably positioned upon a couch-like support structure and means are provided for adjustably positioning the complementary helmet sections relative to the head and body of the user whereby the scalp massaging apparatus of this invention may be adjusted and positioned so as to accommodate different head sizes and persons of different stature.

BEST MODE OF CARRYING OUT THE INVENTION

Figure 1:
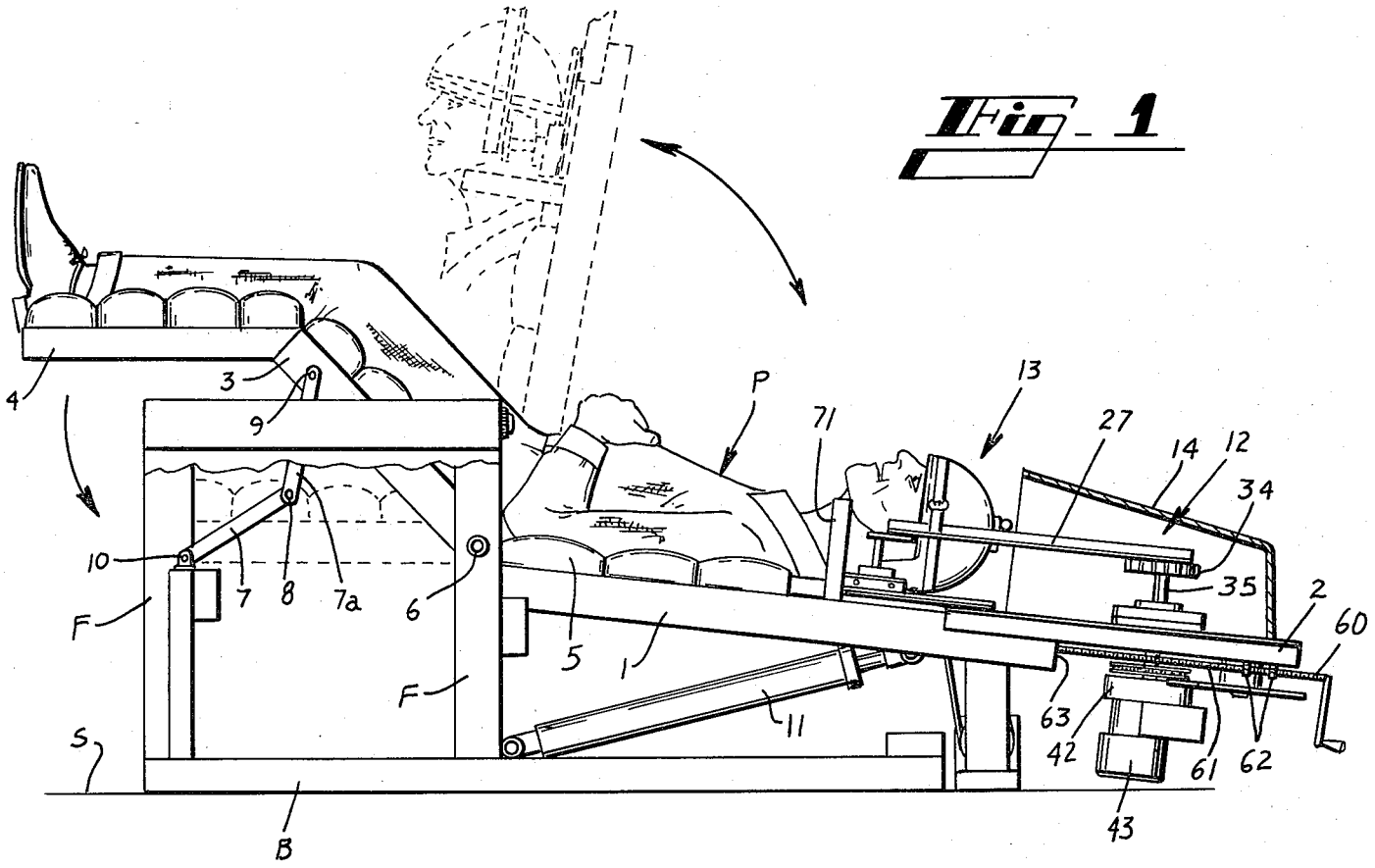
FIG. 1 is an overall side view of the invention which shows the couch-like structure on which the body of the user is disposed in a reclined position together with an overall schematic side view of the massaging and adjusting apparatus formed according to the invention.

With reference to FIG. 1 the numeral 1 designates the main portion of a couch-like structure which includes a base plate 2 slidaly mounted relative to main portion 1 together with seat portion 3 and leg supporting portion 4. This couch-like structure is provided with cushion means 5 and is pivotally supported at 6 on frame structure F which includes a base portion B arranged to rest on a slidable support surface S such as the floor of a building. Seat portion 3 is interconnected with the frame F by means of a pair of links 7 and **7*a* which are pivotally connected together at 8. Link 7*a* is pivoted to seat portion 3 at 9 and link 7 is pivoted to a part of frame F at pivot 10. The normal reclined position of the patient P is shown in FIG. 1 in solid lines and the upright sitting position of the patient P is generally indicated by dotted lines. Movement of the couch-like structure is effected by means of a suitable hydraulic mechanism generally indicated at 11** and which is controlled by suitable mechanism of known type which is omitted from the drawings for the sake of simplicity.

As is apparent from FIG. 1, vibratory driving means generally designated by the numeral 12 is mounted on base plate 2 and is interconnected with helmet sections generally designated by the numeral 13. As is obvious, the head of the patient is received by the helmet sections 13 and the vibratory driving means 12 is enclosed within housing 14 mounted on the base plate 2.

Figure 2:
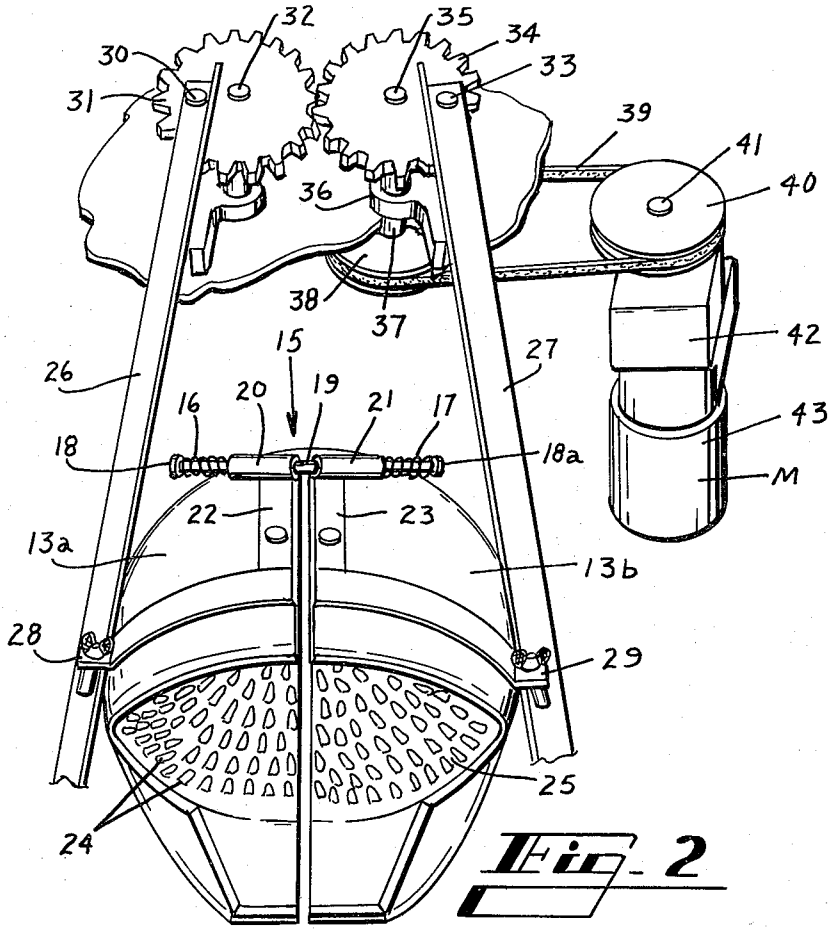
FIG. 2 is an enlarged schematic view of the helmet sections shown interconnected with their associated reciprocatory driving rods as well as the eccentric driving elements which impart massaging motion to the driving rods as well as the driving structure for rotating the eccentric driving elements and which together constitute vibratory driving means.
Figure 5:
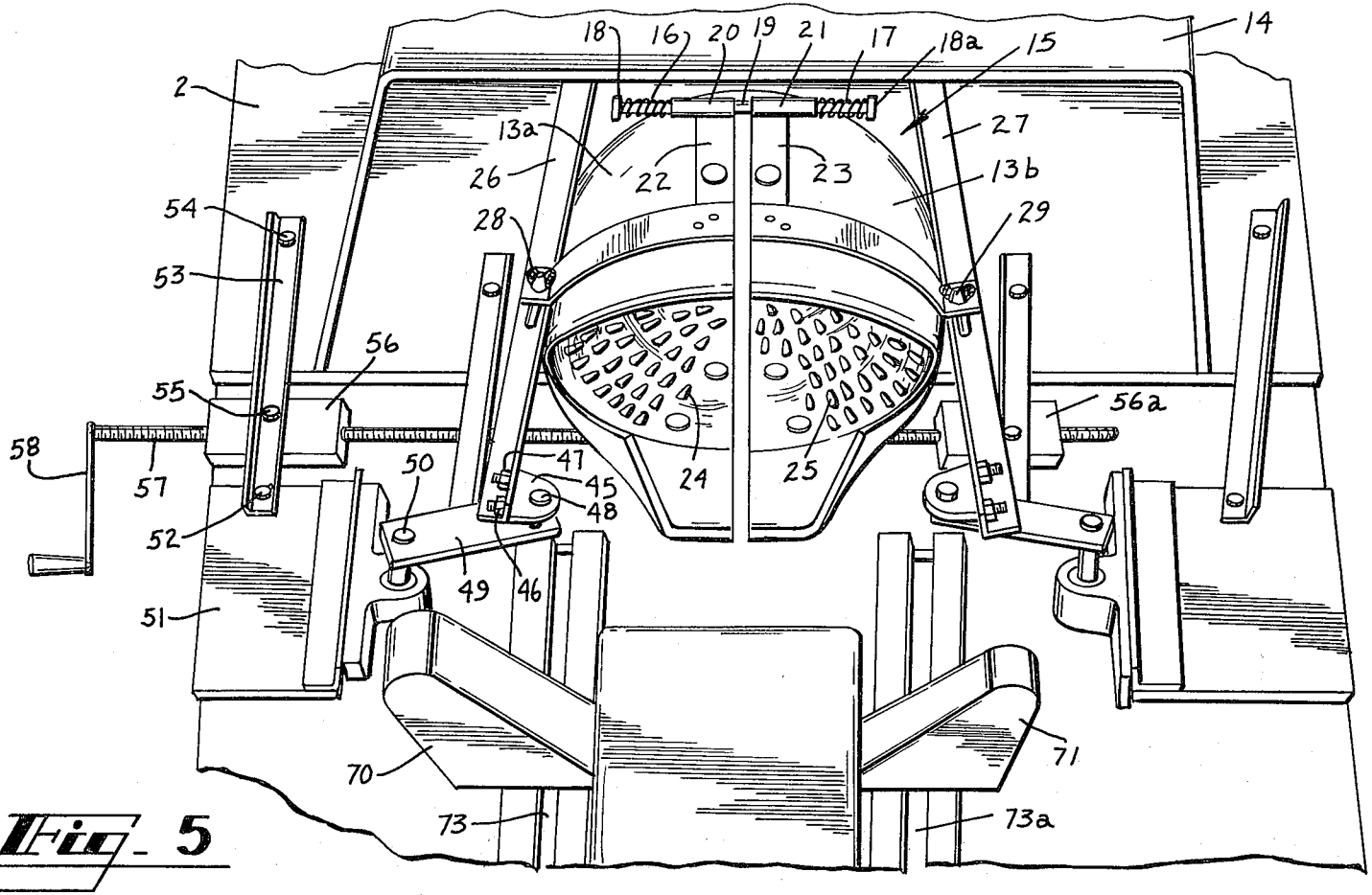

The helmet sections **13*a* and 13*b* are best shown in FIGS. 2 and 5 and according to a feature of the invention are biased toward each other by biasing means generally designated by the numeral 15. This biasing means comprises a pair of biasing springs 16 and 17** which engage nuts 18 and 18*a* threadedly mounted or the ends of rod 19 respectively which is slidably supported by sleeves 20 and 21 respectively secured to helmet sections 13*a* and 13*b*. Thus the biasing springs 16 and 17 urge the sleeves 20 and 21 toward each other and since the sleeves 20 and 21 are mounted on brackets 22 and 23 to the helmet sections 13*a* and 13*b* respectively the effect is to urge the helmet sections 13*a* and 13*b* toward each other and toward the head of the user. As is best shown in FIGS. 2 and 5 the inner surfaces of helmet sections 13*a* and 13*b* are covered with sponge-like cone-shaped fingers 24 and 25 which engage the scalp of the user.

For imparting reciprocatory massaging movement to the helmet sections 13*a* and 13*b*, a pair of rods 26 and 27 are pivotally connected respectively at 28 and 29 to the helmet sections 13*a* and 13*b*. Rod 26 is pivotally connected at 30 to rotatable gear 31 which is rotatable about shaft 32 affixed to base plate 2. Rod 27 is pivoted at 33 to gear 34 which is rotatable about shaft 35 mounted on base plate 2. Rotation of gear 34 imparts rotation of the opposite direction to gear 31. Because the pivots 30 and 33 are eccentrically mounted relative to the shafts 32 and 35, the result of the rotation of gears 31 and 34 is to impart reciprocatory motion to rods 26 and 27 and reciprocatory massaging action to helmet sections 13*a* and 13*b*.

For rotating gear 34, a pinion 36 is mounted on a shaft 37 which in turn is rigidly secured to pulley 38 which in turn is driven by belt 39 driven by pulley 40 mounted on shaft 41. Shaft 41 protrudes from a gear box 42 which in turn is directly coupled to motor 43 so that rotation of motor 43 through the system just described imparts reciprocatory motion to the helmet sections 13*a* and 13*b* which are yieldably biased toward the head of the user by means of biasing springs 16 and 17.

For the purpose of accommodating different head sizes of the users of the apparatus, the structure best shown in FIG. 5 is provided in accordance with a feature of this invention. With reference to FIG. 5, a bracket 45 is rigidly secured to an end of rod 26 by means of a pair of bolts 46 and 47. A bolt 48 is mounted on bracket 45 and is pivotally connected to support link 49 which in turn is pivoted at 50 to support block 51. Support block 51 is pivoted at 52 to a link 53 which in turn is pivoted at 54 to base plate 2. Line 53 is also pivoted at 55 to adjusting block 56 which in turn is threadedly related with externally threaded adjusting rod 57 rigidly secured at its left-hand end to adjusting crank 58. Manual rotation of adjusting crank 58 thus imparts rotation to threaded screw 57 which in turn imparts transverse movement to adjusting block 56 to link 53 and block 51 as well as to support link 49 and the bracket 45 which in turn imparts transverse movement of the adjacent end of link 26 and thus imparts transverse movement to helmet sections 13*a* so as to accommodate different head sizes of the user of the apparatus.

Helmet section 13*b* is also adjusted transversely by means of adjusting screw 57 because that screw is threadedly related with adjusting block 56*a* thereby to impart transverse motion to the parts associated with rod 27 and helmet section 13*b*, the components of the adjusting elements for helmet section 13*b* being identified by the same numerals as are used in connection with the adjusting mechanism for rod 26 except that the numerals associated with rod 27 have the letter "a" appended thereto. A detailed description of the functioning of the adjusting apparatus associated with rod 27 is not deemed necessary as being obvious in view of the description of the adjusting mechanism for rod 26.

Figure 3:
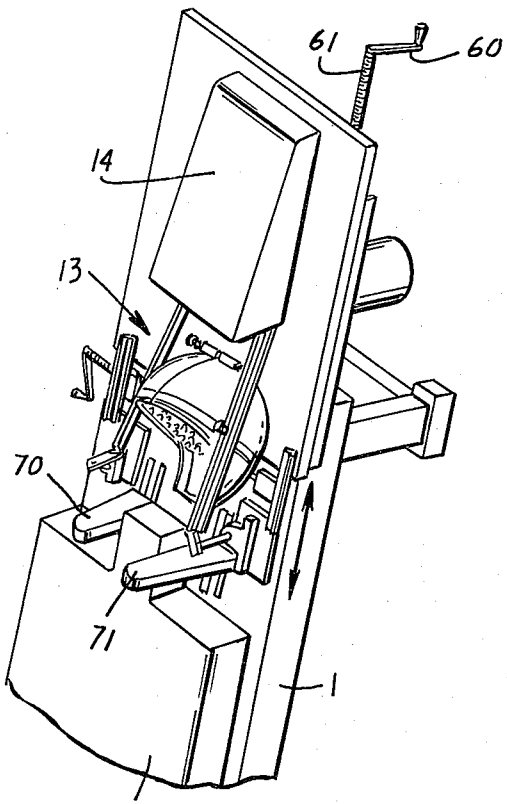
FIG. 3 is a perspective view of the right hand end of the structure shown in FIG. 1 but with the body and head of the user removed so as to show the helmet sections as mounted on the couch-like structure and the base plate which forms a part of the couch-like structure.

Since the body and head of the user are positioned and held in position according to a feature of this invention relative to the helmet sections 13*a* and 13*b*, it is necessary to provide for the fact that persons of different stature must be accommodated. To this end and in accordance with a feature of this invention, the helmet sections 13*a* and 13*b* as well as the vibratory driving means 12 are mounted on the base plate 2 and may be adjusted relative to the seat portion 3 and to the main part 1 of the couch-like support structure. Thus the base plate 2 is slidably mounted on the main portion 1 of the couch-like structure on which the user and the mechanism 12 are mounted. Thus for imparting sliding movement to base plate 2 relative to the main portion 1 of the couch-like structure, the crank means best shown in FIGS. 1 and 3 is provided and is designated by the numeral 60. Crank means 60 is provided with an externally threaded shaft 61 which engages an internally threaded bracket 62 which is rigidly mounted to the underneath surface of base plate 2. The left-hand end of threaded rod 61 is journalled in the part 63 of the main portion 1 of the couch-like support structure so that the threaded relationship between screw 61 and bracket 62 imparts sliding movement to base plate 2 relative to the main part 1 of the couch-like structure so that the base plate 2 as viewed in FIG. 1 may be moved from left to right and vice versa. Since the vibratory driving means as well as the helmet elements 13*a* and 13*b* are all supported by the base plate 2, operation of crank 60 in effect adjusts the helmet sections 13*a* and 13*b* relative to the seat portion 3 of the couch-like structure and thus enables the device to accommodate users of different stature so that the head of the user is comfortably received within the helmet sections 13*a* and 13*b*.

According to one aspect of the invention, the feet of the user are elevated relative to the head and scalp and by this means the flow of blood to the scalp is facilitated. Since the body of the user might tend to slide toward the helmet sections and thus impart an undue pressure on the head and scalp of the user, the body of the user is positioned relative to the couch-like structure according to a feature of this invention. Toward this end, shoulder engaging blocks 70 and 71 are slidably mounted on the main portion 1 of the couch-like structure as is best shown in FIGS. 1, 3, 4 and 5. Block 70 is provided with a supporting bolt 72 which is slidable within a slot 73 formed in the main portion 1 of the couch-like structure. Movement of shoulder engaging block 70 and its guiding bolt 72 mounted within slot 73 is imparted by externally threaded screw 74 which cooperates with internally threaded nuts 75, 76 and 77 which are rigidly mounted to bracket 78 which in turn is connected with triangular structure generally designated at 79 and best shown in FIG. 4A by means of bolt 80 and link 81. Triangular structure 79 includes bolts 72, 72*a* and 79*a* as is best shown in FIG. 4A. Thus rotation of externally threaded screw 74 imparts longitudinal motion to shoulder engaging block 70. Sliding movement is imparted to block 71 by the same structure and the bolt 72*a* for block 71 is slidable in slot 73*a*.

Figure 4:
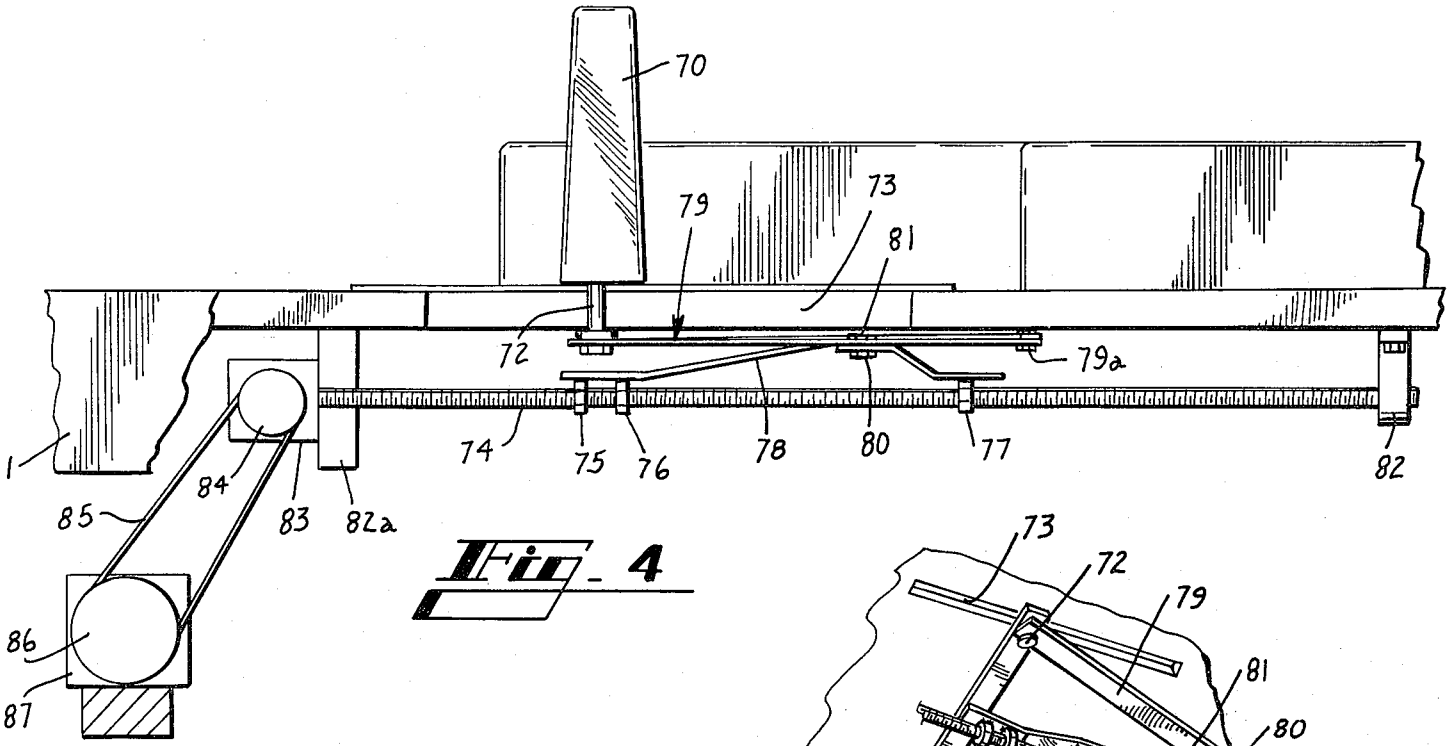
FIG. 4 is a view from the side of a part of the couch-like structure shown in FIG. 1 and shows a mechanism for adjusting the position of the body of the user relative to the couch-like structure together with driving means for adjusting the body positioning means.
Figure 4A:
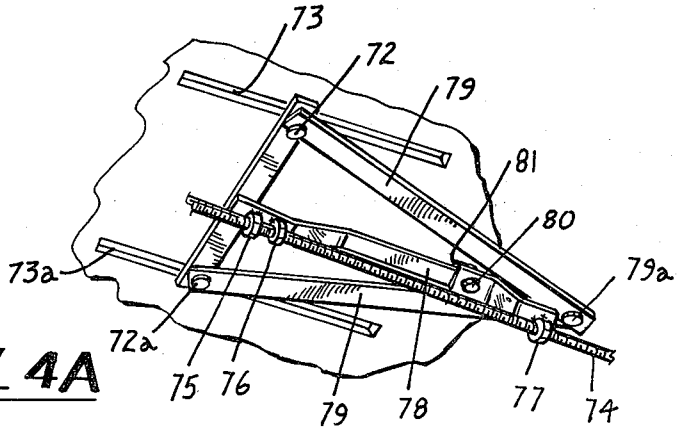
FIG. 4A is a fragmentary sectional view from below of a portion of the structure shown in FIG. 4 whereby the driving means is interconnected with the body positioning means formed according to this invention and FIG. 5 is an enlarged perspective view of the helmet sections formed according to this invention together with yieldable biasing means arranged to urge those sections toward each other and toward the head of the user together with means for adjusting the relative positions of the helmet sections and of the reciprocatory driving rods which are interconnected with the helmet sections and which are laterally adjustable by means best shown in FIG. 5.

As is best shown in FIG. 4, screw 74 is journalled in support brackets 82 at one end and 82*a* at the other. Screw 74 is driven by gear box 83 which is operated by pulley 84, belt 85, pulley 86 and motor 87. Of course motor 87 is reversible so as to drive the shoulder engaging blocks 70 and 71 in both directions. Thus for a given individual the blocks 70 and 71 are suitably adjusted to engage the shoulders of the user and thereby to fix the position of the body and head of the user relative to the helmet sections 13*a* and 13*b*.

INDUSTRIAL APPLICABILITY

Apparatus constructed according to this invention is well suited fo use in private clubs or in public exercise rooms and is particularly well suited for treating the scalp of a user so as to impart a healthful and invigorating massaging action conducive to healthy treatment of the hair and scalp of the user.

I claim:

1. A scalp massaging apparatus comprising a pair of separate complementary relatively movable helmet sections having sponge-like inner surfaces and arranged to receive the head of the user, yieldable biasing means arranged to bias said helmet sections toward each other and toward the head of the user, vibratory driving means mounted on a couch-like structure arranged to support the body of the user in a reclined position during use of the apparatus and including a pair of reciprocatory driving rods respectively interconnected with said helmet sections and effective to impart reciprocatory movement thereto thereby to massage the scalp of the user, an eccentric driving element mounted on said couch-like structure and interconnected with each of said driving rods near one end thereof, each of said driving rods being pivotally connected at the other end thereof to a support link pivotally mounted on a support block mounted on a part of said couch-like support structure, said support blocks are movably mounted on said couch-like support structure, and an adjusting crank threadedly related with said support blocks so as to impart adjusting movement thereto thereby to accommodate different head sizes.

2. Apparatus according to claim 1 wherein a pair of shoulder engaging blocks are mounted on said couch-like structure adjacent said helmet sections for positioning the head and body of the user relative to said helmet sections.

3. Apparatus according to claim 2 wherein said shoulder engaging blocks are adjustable.

4. Apparatus according to claim 1 wherein said helmet sections, said biasing means and said driving means are mounted on a base plate movably mounted on said couch-like support structure and forming a part thereof and wherein crank means is threadedly related with said base plate for imparting movement thereto so as to adapt the apparatus for use by individuals of diffent stature.

5. Apparatus according to claim 1 wherein said couch-like structure is movable between inclined and upright seated positions of the user.

* * * * *